US011944220B2

(12) United States Patent
Cote

(10) Patent No.: US 11,944,220 B2
(45) Date of Patent: Apr. 2, 2024

(54) BEDDING SYSTEM AND METHOD

(71) Applicant: Sylvie Cote, St-Augustin de Desmaures (CA)

(72) Inventor: Sylvie Cote, St-Augustin de Desmaures (CA)

( * ) Notice: Subject to any disclaimer, the term of this patent is extended or adjusted under 35 U.S.C. 154(b) by 0 days.

(21) Appl. No.: 16/666,824

(22) Filed: Oct. 29, 2019

(65) Prior Publication Data

US 2020/0128967 A1 Apr. 30, 2020

Related U.S. Application Data

(60) Provisional application No. 62/766,582, filed on Oct. 29, 2018.

(51) Int. Cl.
*A47G 9/02* (2006.01)
*A47C 21/02* (2006.01)

(52) U.S. Cl.
CPC ..... *A47G 9/0223* (2013.01); *A47C 21/022* (2013.01); *A47G 9/02* (2013.01); *A47G 9/0238* (2013.01); *A47G 9/0246* (2013.01)

(58) Field of Classification Search
CPC ..... A47G 9/02; A47G 9/0238; A47G 9/0246; A47G 9/04; A47G 9/0223; A47G 2009/004; A47C 21/02; A47C 21/022; A47C 21/028
USPC ..... 5/495, 496, 497, 498, 499, 500, 502
See application file for complete search history.

(56) References Cited

U.S. PATENT DOCUMENTS 2,736,043 A * 2/1956 Temple ..... A47G 9/0238 5/502
2,799,870 A * 7/1957 Sullivan ..... A47G 9/0238 5/495
2,810,921 A * 10/1957 Seidenberg ..... A47G 9/0238 5/501
4,021,869 A * 5/1977 Root ..... A47G 9/0246 5/497
5,084,929 A * 2/1992 Staudinger ..... A47D 15/008 5/494
5,099,531 A * 3/1992 Schmier ..... A47G 9/02 5/692
5,794,285 A * 8/1998 Burch ..... A47G 9/02 5/500
7,086,102 B1 * 8/2006 Frazier ..... A47G 9/02 5/497
7,140,053 B1 * 11/2006 Mangano ..... A47G 9/02 5/493

(Continued)

*Primary Examiner* — Michael Safavi
(74) *Attorney, Agent, or Firm* — Philip A. Swain; Equinox IP Inc.

(57) ABSTRACT

The present disclosure relates to a bedding system that can minimize the time, labor and/or frustration associated with making a bed. It comprises a fitted sheet to fit over the mattress top surface and side surfaces and a flat sheet to fit over the fitted sheet outer surface. The flat sheet lower section is being secured/coupled to the fitted sheet lower section. The bedding system further comprises a bedspread to fit over the flat sheet outer surface. The bedspread lower longitudinal edge, the bedspread first side longitudinal edge, the bedspread second side longitudinal edge and the bedspread upper section are being releasably secured to the flat sheet lower longitudinal edge, the flat sheet first side longitudinal edge, the flat sheet second side longitudinal edge and the flat sheet upper section along their respective lengths.

12 Claims, 5 Drawing Sheets

(56) References Cited

U.S. PATENT DOCUMENTS

| | | | | |
|---|---|---|---|---|
| 8,898,834 | B1 * | 12/2014 | Huber | A47C 31/105 5/498 |
| 9,549,625 | B1 * | 1/2017 | Wilkinson | A47G 9/0223 |
| 2001/0032358 | A1 * | 10/2001 | Talley-Williams | A47G 9/02 5/482 |
| 2007/0118988 | A1 * | 5/2007 | Ho | A47G 9/02 5/496 |
| 2007/0214569 | A1 * | 9/2007 | Miller | A47G 9/02 5/482 |
| 2008/0104751 | A1 * | 5/2008 | Friedland | A47G 9/02 5/502 |
| 2009/0013467 | A1 * | 1/2009 | Moorhouse | A47G 9/02 5/496 |
| 2009/0044337 | A1 * | 2/2009 | McKee | A47G 9/02 5/496 |
| 2009/0178197 | A1 * | 7/2009 | Swihart | A47G 9/02 5/496 |
| 2011/0023234 | A1 * | 2/2011 | Bolish | A47G 9/02 5/496 |
| 2012/0204348 | A1 * | 8/2012 | Bayer | A47G 9/08 5/413 R |
| 2014/0013510 | A1 * | 1/2014 | Mcaleney | A47G 9/02 5/496 |
| 2016/0081498 | A1 * | 3/2016 | McKenzie | A47G 9/02 5/421 |
| 2016/0100700 | A1 * | 4/2016 | Dunwood | A47G 9/02 5/496 |
| 2016/0286988 | A1 * | 10/2016 | Robert | A47G 9/02 |
| 2017/0164767 | A1 * | 6/2017 | Serafini | A47G 9/02 |
| 2020/0187683 | A1 * | 6/2020 | Serafini | A47G 9/02 |

* cited by examiner

BEDDING SYSTEM AND METHOD

TECHNICAL FIELD

The description relates in general to beddings. More particularly, the present description relates to bedding systems and methods.

BACKGROUND

The general procedure for making a bed consists of placing a fitted sheet on the mattress and assembling a flat sheet over fitted sheet and mattress. The next step provides for tucking in the corners of the flat sheet and sides, leaving an opening to the top of the mattress. A comforter or bedspread is then placed atop the flat sheet to almost fully cover the bed. Comforters, bedspreads, blankets, quilts and the like are used to trap air around the body of a sleeper, providing heat to the sleeper. These also protect bedding sheets (namely fitted and flat sheets) from soil as well as serve a decorative purpose.

The bedding assemblies currently found on the market present at least the following drawbacks. First, the process of assembling the conventional fitted sheet, flat sheet and bedspread/comforter to the mattress is time consuming, tedious and a bit cumbersome. Second, flat sheet is likely to be kicked off of bed while the user is sleeping. Thirdly, a traditional flat sheet is sometimes hard to secure to mattress when making bed for a child or an elderly person for instance. Fourthly, bed is more than often not made properly and in an aesthetical manner. Finally, and most importantly, the sleeper will more than often touches bedspread inner surface (as flat sheet moves from its initial position during night), thus increasing the number of launderings that need to be performed by the user to wash its bedspread.

There is therefore a need for an improved bedding system that can minimize the time, labor and/or frustration associated with making a bed.

SUMMARY

It is an object of the present disclosure to provide a bedding system that overcomes or mitigates one or more disadvantages of known bedding systems, or at least provides a useful alternative.

According to an embodiment, there is provided a bedding system for covering a mattress defining a mattress top surface and mattress side surfaces, the bedding system comprising: a fitted sheet to fit over the mattress top surface and the mattress side surfaces, the fitted sheet defining a fitted sheet outer surface and a fitted sheet lower section; a flat sheet to fit over at least part of the fitted sheet outer surface, the flat sheet defining a flat sheet outer surface, a flat sheet lower longitudinal edge, a flat sheet first side longitudinal edge, a flat sheet second side longitudinal edge and a flat sheet lower section, at least part of the flat sheet lower section being secured/coupled to at least part of the fitted sheet lower section; and a bedspread to fit over the flat sheet outer surface, the bedspread defining a bedspread outer surface, a bedspread lower longitudinal edge, a bedspread first side longitudinal edge and a bedspread second side longitudinal edge opposite the bedspread first side longitudinal edge, at least part of the bedspread lower longitudinal edge, the bedspread first side longitudinal edge and the bedspread second side longitudinal edge being releasably secured to at least part of respectively the flat sheet lower longitudinal edge, the flat sheet first side longitudinal edge and the flat sheet second side longitudinal edge along their respective lengths.

According to another embodiment, there is provided the bedding as defined above, wherein the flat sheet further defines a flat sheet upper longitudinal edge and further wherein the bedspread further defines a bedspread upper longitudinal edge, at least part of the flat sheet upper longitudinal edge being releasably secured to at least part of one of: the bedspread upper longitudinal edge and the bedspread outer surface.

BRIEF DESCRIPTION OF THE DRAWINGS

Further features and advantages of the present disclosure will become apparent from the following detailed description, taken in combination with the appended drawings, in which.

DETAILED DESCRIPTION

Figure 1:
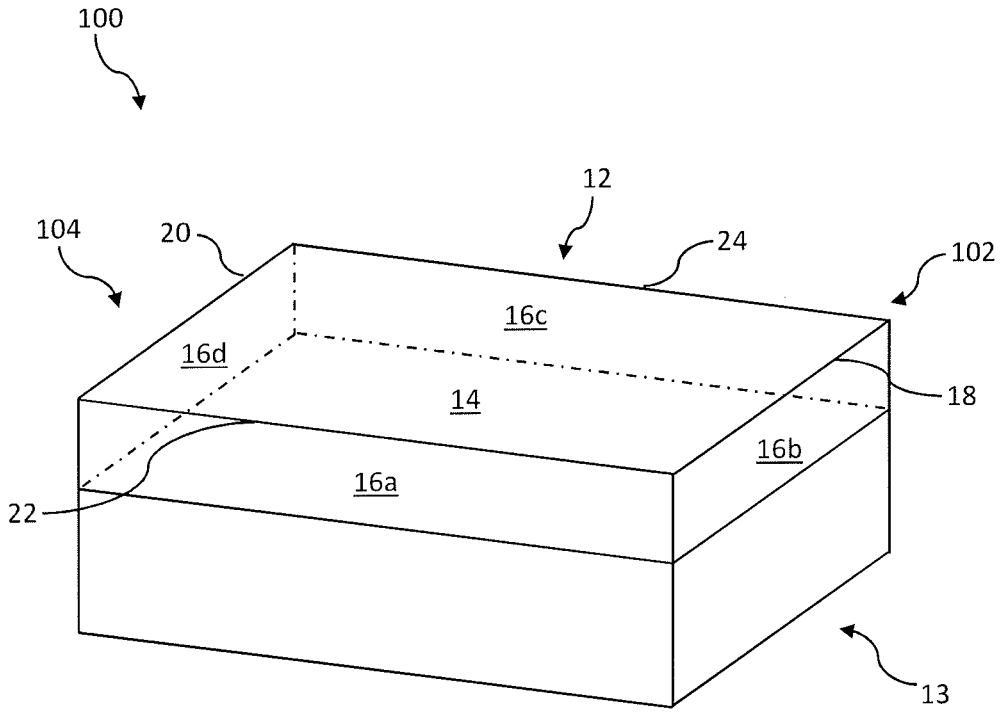
FIG. 1 is a top perspective view of a typical bed.

Referring now to the drawings and more particularly to FIG. 1, there is shown a typical bed 100 defining a bed lower end or a bed foot end 102 and a bed upper end or a bed head end 104 which is found opposite bed lower end 102. Bed 100 includes a mattress 12 and a box spring 13, which supports mattress 12. Mattress 12 defines a mattress top surface 14 and mattress side surfaces 16*a*, 16*b*, 16*c*, 16*d*. Mattress 12 further defines a mattress lower longitudinal edge 18, or mattress foot edge 18, a mattress upper longitudinal edge 20, or mattress head edge 20, which is found opposite mattress lower longitudinal edge 18, a mattress first side longitudinal edge 22 and a mattress second side longitudinal edge 24, which is found opposite mattress first side longitudinal edge 22.

Referring now more particularly to FIGS. 2 to 5B, there is shown a bedding system 10 (FIG. 3) that is adapted to cover mattress top surface 14 as well as mattress side surfaces 16*a*, 16*b*, 16*c*, 16*d* shown in FIG. 1. As better shown in FIGS. 2 and 4, bedding system 10 includes a fitted sheet 26 which is adapted to fit over mattress top surface 14 as well as over mattress side surfaces 16*a*, 16*b*, 16*c*, 16*d* shown in FIG. 1. Fitted sheet 26 defines a fitted sheet outer surface 28, a fitted sheet lower longitudinal edge 30, a fitted sheet upper longitudinal edge 32, which is found opposite fitted sheet lower longitudinal edge section 30, a fitted sheet first side longitudinal edge 34 and a fitted sheet second side longitudinal edge 36, which is found opposite fitted sheet first side longitudinal edge 34. Fitted sheet 26 further defines a fitted sheet lower section 38, or fitted sheet foot section 38, and a fitted sheet upper section 40, or head section 40, which is found opposite fitted sheet lower section 38.

Figure 2:
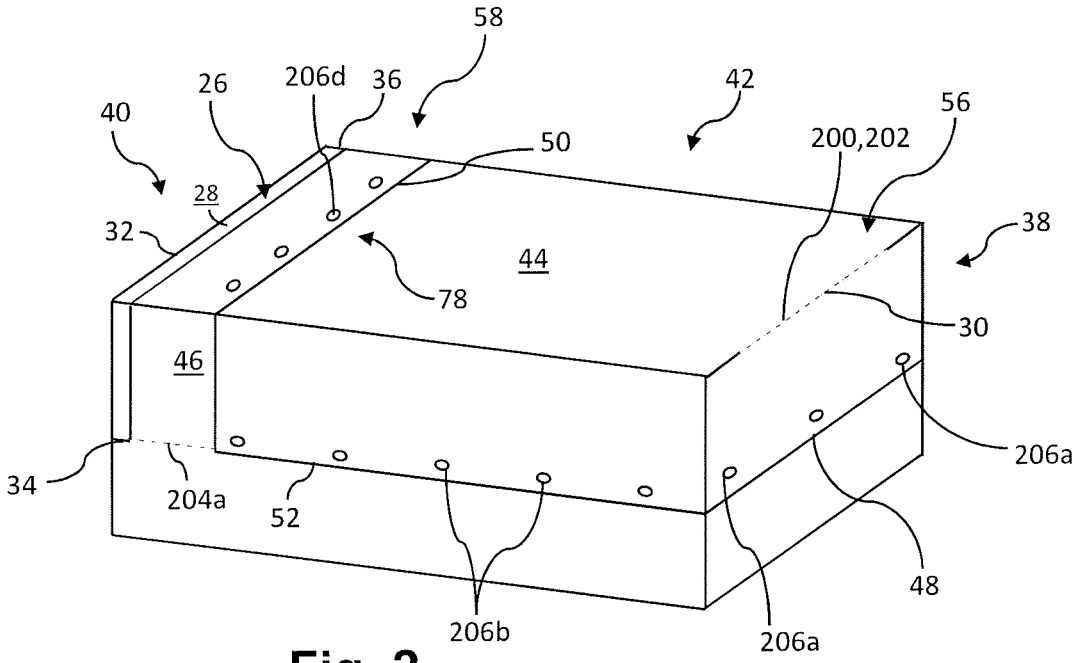
FIG. 2 is a top perspective view of a flat sheet being fixedly secured/coupled to a fitted sheet for covering the top surface and the side surfaces of the mattress shown in FIG. 1.
Figure 3:
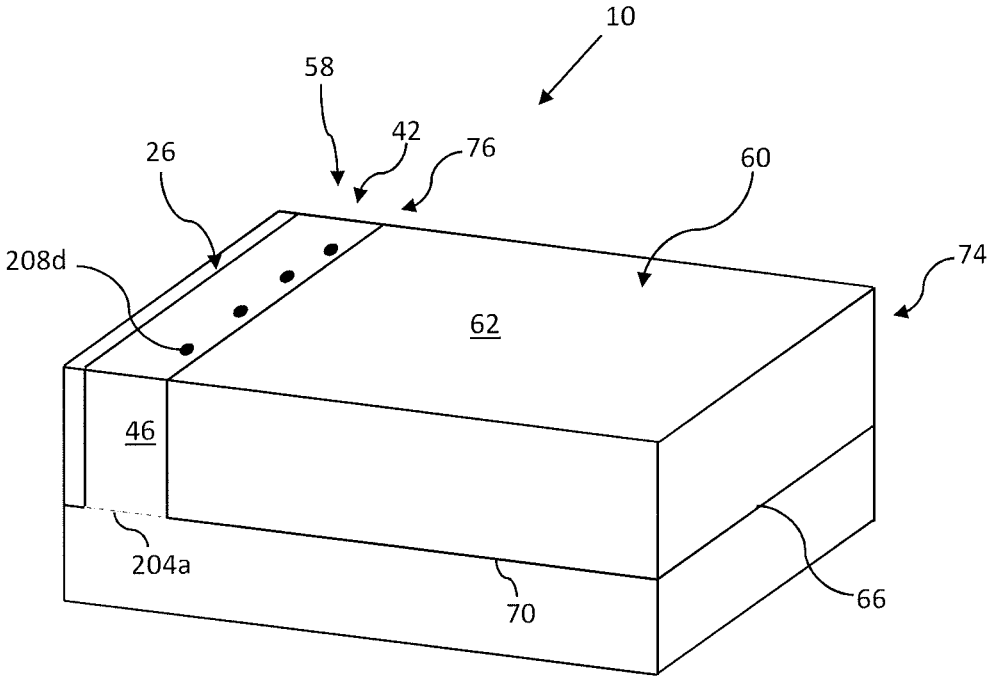
FIG. 3 is a top perspective view of a bedding system in accordance with an embodiment covering the mattress shown in FIG. 1.
Figure 4:
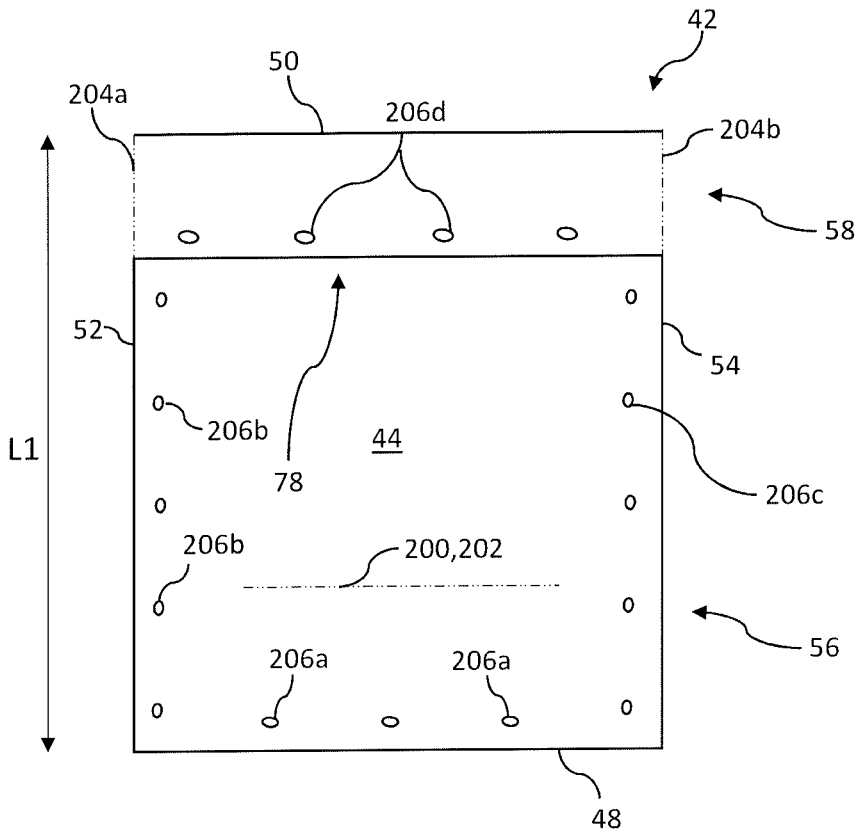
FIG. 4 is a top plan view of the flat sheet fixedly secured/coupled to the fitted sheet shown in FIG. 2.

Still referring to FIGS. 2 and 4, there is shown that bedding system 10 further includes a flat sheet 42 to fit over fitted sheet outer surface 28 (or at least part of it). It is to be mentioned that even if flat sheet 42 is shown on FIG. 2 to fit over only part of fitted sheet outer surface 28, flat sheet 42 may cover totality of fitted sheet outer surface 28, for esthetic purposes. Flat sheet 42 defines a flat sheet outer surface 44, a flat sheet inner surface 46, a flat sheet lower longitudinal edge 48, a flat sheet upper longitudinal edge 50, which is found opposite flat sheet lower longitudinal edge 48, a flat sheet first side longitudinal edge 52 and a flat sheet second side longitudinal edge 54, which is found opposite flat sheet first side longitudinal edge 52. Flat sheet 42 further defines a flat sheet lower section 56, or flat sheet foot section 56, and a flat sheet upper section 58, or flat sheet head section 58, which is found opposite flat sheet lower section 56. As shown, flat sheet lower section 56 is being fixedly secured/coupled to fitted sheet lower section 38 along line 200. Indeed, as best shown in FIGS. 2 and 4, flat sheet 42 is sewn to fitted sheet 26 along part of one edge, namely along fitted sheet lower longitudinal edge 30, which is found to be aligned with mattress lower longitudinal edge 18 when combination of fitted sheet 26 and flat sheet 42 is installed onto mattress 12. This is demonstrated in the Figures by schematically illustrated stiches 202. Securing flat sheet lower section 56 to fitted sheet 26 greatly enhances the likelihood that flat sheet 42 will not be kicked off of bed 100 while the user is sleeping. In addition, according to this configuration, flat sheet 42 is much easier than traditional flat sheets to secure to mattress 12 (bed 100) when making it as it is already secured to fitted sheet 26. It is further to be mentioned that fitted sheet outer surface 28 will interface with part of flat sheet inner surface 46, as the other part of flat sheet inner surface 46, the one defining bedspread receiving pocket 78, faces opposite mattress 12. Thus, in the case where flat sheet outer surface 44 differs from flat sheet inner surface 46 (in texture, color, material, etc.), the most fashionable flat sheet surface would be flat sheet inner surface as to provide a nice looking bedspread receiving pocket 78 for esthetic purposes.

It is to be mentioned that even if flat sheet 42 is shown to be sewn to fitted sheet 26 along part of fitted sheet lower longitudinal edge 30, a person skilled in the art to which bedding system 10 pertains would understand that flat sheet 42 may be fixedly coupled/secured to fitted sheet 26 using any other suitable techniques. Moreover, that person skilled in the art to which bedding system 10 pertains would also understand that flat sheet 42 does not necessarily need to be coupled/secured to fitted sheet 26 specifically at fitted sheet lower longitudinal edge 30, but that flat sheet 42 may be coupled/secured to fitted sheet 26 according to different other locations (at other specific points or along other specific lines and/or edges). It is further to be mentioned that even if flat sheet lower section 56 is being described above as being fixedly secured/coupled to fitted sheet lower section 38, a person skilled in the art to which bedding system 10 pertains would understand that flat sheet lower section 56 may be releasably secured/coupled to fitted sheet lower section 38, as long as, as mentioned above, it greatly enhances the likelihood that flat sheet 42 will not be kicked off of bed 100 while the user is sleeping, and further, as long as flat sheet 42 is much easier than traditional flat sheets to secure to mattress 12 (bed 100) when making it (as it is already secured to fitted sheet 26). Flat sheet lower section 56 may therefore be, alternatively, releasably secured to fitted sheet lower section 38 using mating connectors, similarly to the one used to provide releasable connection between bedspread 60 and flat sheet 42, described in more details below.

Still referring to FIGS. 2 and 4, there is shown that bedding system 10 further defines a bedspread receiving pocket 78 which is adapted and configured to receive bedspread upper section 76. Indeed, bedspread receiving pocket 78 is created when flat sheet upper section 58 is properly folded on itself. Along flat sheet first and second side longitudinal edges 52, 54 provided in flat sheet upper section 58, stiches 204*a*, 204*b* are provided. Again, a person skilled in the art to which bedding system 10 pertains would understand that such connection may be provided as a fixed connection, via stiches or provided by any other suitable techniques, but also as a releasable connection, as long as it provides bedspread receiving pocket 78 adapted to receive bedspread upper section 76 in a nice aesthetical manner.

Now referring to FIGS. 3, 4, 5A and 5B, there is shown that bedding system 10 further includes a bedspread 60 to fit over flat sheet outer surface 44. It is to be mentioned that even if bedspread 60 is shown on FIG. 3 to fit over only part of fitted sheet outer surface 28, bedspread 60 may cover totality of fitted sheet outer surface 28, for esthetic purposes. Bedspread 60 defines a bedspread outer surface 62, a bedspread inner surface 64, a bedspread lower longitudinal edge 66, a bedspread upper longitudinal edge 68, found opposite bedspread lower longitudinal edge 66, a bedspread first side longitudinal edge 70 and a bedspread second side longitudinal edge 72 opposite the bedspread first side longitudinal edge 70. Bedspread 60 further defines a bedspread lower section 74, or bedspread foot section 74, and a bedspread upper section 76, or bedspread head section 76, found opposite bedspread lower section 74.

Figure 5A:
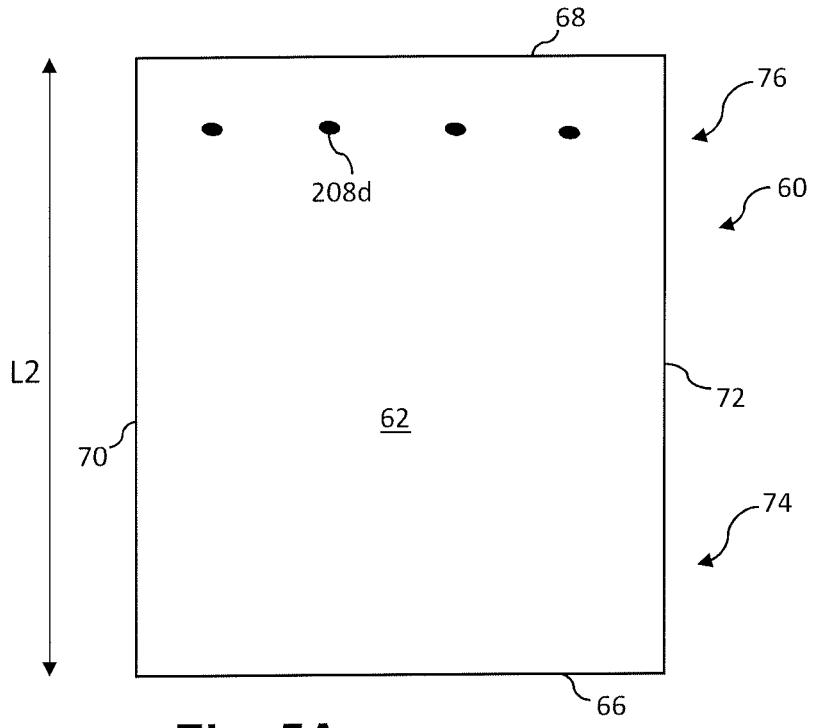
FIG. 5A is a top plan view of the bedspread shown in FIG. 3.
Figure 5B:
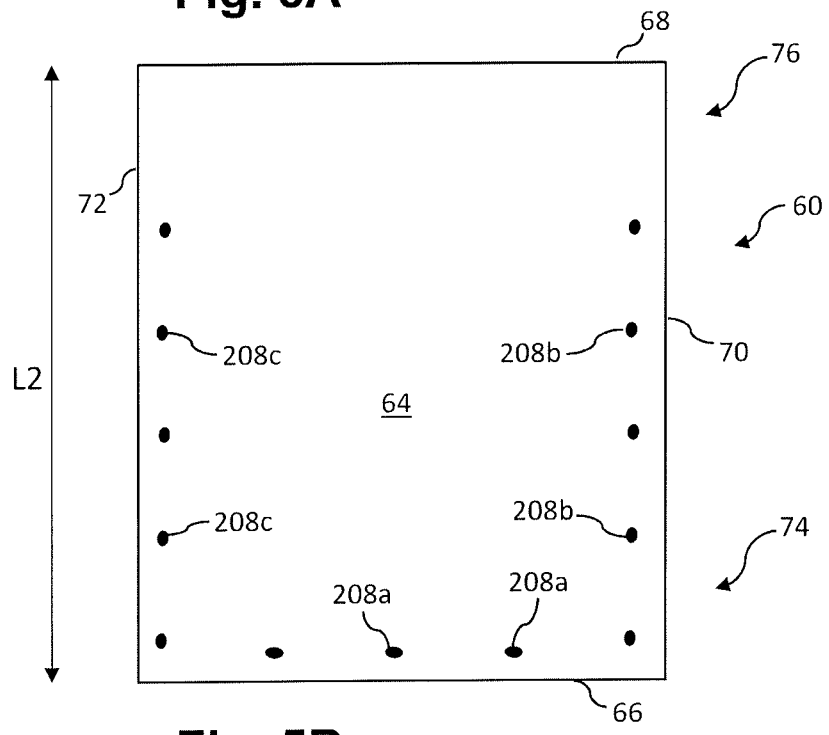
FIG. 5B is a bottom plan view of the bedspread shown in FIG. 3.

Still referring to FIGS. 3, 4, 5A and 5B, there is shown that bedspread lower longitudinal edge 66, bedspread first side longitudinal edge 70, bedspread second side longitudinal edge 72 and bedspread upper section 76 are being releasably secured to respectively flat sheet lower longitudinal edge 48, flat sheet first side longitudinal edge 52, flat sheet second side longitudinal edge 54 and flat sheet upper section 58 along their respective lengths. FIG. 4 shows that flat sheet 42 defines sets of longitudinally aligned spaced apart openings 206*a*, 206*b*, 206*c*, 206*d* at its flat sheet lower longitudinal edge 48 (set of longitudinally aligned spaced apart openings 206*a*), at its flat sheet first side longitudinal edge 52 (set of longitudinally aligned spaced apart openings 206*b*), at its flat sheet second side longitudinal edge 54 (set of longitudinally aligned spaced apart openings 206*c*) and further, about its flat sheet upper section 58 (set of longitudinally aligned spaced apart openings 206*a*). On the other hand, FIGS. 5A and 5B show that bedspread 60 defines sets of longitudinally aligned spaced apart connectors/buttons 208*a*, 208*b*, 208*c*, 208*d* at its bedspread lower longitudinal edge 66 (set of longitudinally aligned spaced apart connectors/buttons 208*a*), at its bedspread first side longitudinal edge 70 (set of longitudinally aligned spaced apart connectors/buttons 208*b*), at its bedspread second side longitudinal edge 72 (set of longitudinally aligned spaced connectors/buttons 208*c*) and further, about its bedspread upper section 76 (set of longitudinally aligned spaced apart connectors/buttons 208*a*). Therefore, each connector/button may be introduced into its respective/corresponding opening to releasably secure/couple bedspread lower longitudinal edge 66, bedspread first side longitudinal edge 70, bedspread second side longitudinal edge 72 and bedspread upper section 76 to respectively flat sheet lower longitudinal edge 48, flat sheet first side longitudinal edge 52, flat sheet second side longitudinal edge 54 and flat sheet upper section 58 along their respective lengths. Length L2 of bedspread 60 shown in FIGS. 5A and 5B will therefore equals length L1 of flat sheet 42 shown in FIG. 4.

Even if connectors/buttons are shown in FIGS. 2, 3, 4, 5A and 5B to be releasably interacting/connecting with openings, a person skilled in the art to which bedding system 10 pertains would understand that any other suitable connection may be used (snaps, elastics, rings, magnets to be aligned together, hook and loop connectors, zippers and the like), as long as it remains easy and convenient to detach bedspread 60 from flat sheet 42 and connect them together. A different number of openings/buttons may further be provided.

According to its configuration, bedding system 10 described above provides the following advantages. First, as mentioned above, securing flat sheet lower section 56 to fitted sheet 26 greatly enhances the likelihood that flat sheet 42 will not be kicked off of bed 100 while the user is sleeping. Secondly, according to this configuration, flat sheet 42 is much easier than traditional flat sheets to secure to mattress 12 (bed 100) when making it as it is already secured to fitted sheet 26. Thirdly, bed 100 will also be made properly and in an aesthetical manner, thanks to flat sheet upper section 58 that is provided with bedspread receiving pocket 78 (formed by first and second sets of stiches 204*a*, 204*b* that each links flat sheet first and second side longitudinal edges 52, 54). Fourthly, and most importantly, because bedspread 60 is releasably secured/coupled to flat sheet 42 along full length of its four edges, namely bedspread lower longitudinal 66, bedspread first side longitudinal edge 70, bedspread second side longitudinal edge 72 and bedspread upper section 76, the sleeper will never touch bedspread inner surface 64, thus decreasing the number of launderings that need to be performed by the user to wash its bedspread 60. Accordingly, even if not illustrated, it is important to be mentioned that instead of releasably coupling/securing bedspread upper section 76 to flat sheet upper section 58 by introducing bedspread upper section 76 into bedspread receiving pocket 78 (provided to create nice aesthetic effect) and releasably connecting set of longitudinally aligned and spaced apart connectors/buttons 208*d* to set of longitudinally aligned and spaced apart openings 206*d*, it is to be mentioned that other configurations may be possible. Indeed, it would be possible to releasably connect bedspread upper longitudinal edge 68 directly to flat sheet upper longitudinal edge 50 (when a bedspread receiving pocket such as pocket 78 is not provided), as long as the configuration does not allow the sleeper to touch bedspread inner surface 64.

It is to be mentioned that the bedspread in intended to mean any type of bedspread, comforter, blanket, quilt, covering or the like. Fitted sheet, flat sheet and bedspread may be made of any material, and it may be provided with any suitable size or shape to properly fit onto the mattress.

The bedding system as described above may help facilitating bed making, potentially so that the user cannot mis make the bed. The user can consistently and efficiently make the bed in an esthetical manner without much hassle. Further, the system and method described above leads to appreciable time saving (while making bed and further, by decreasing the number of launderings required). In addition, the labor input can be minimized, as the mattress does not have to be lifted up to tuck the flat sheet under mattress. Finally, during use, the flat sheet will not become displaced.

While preferred embodiments have been described above and illustrated in the accompanying drawings, the scope of the claims should not be limited by the preferred embodiments set forth in the examples, but should be given the broadest interpretation consistent with the description as a whole.

The invention claimed is:

1. A bedding system for covering a mattress having a mattress top surface and mattress side surfaces, the bedding system comprising:

a fitted sheet sized and shaped to fit over the mattress top surface and the mattress side surfaces, the fitted sheet defining a fitted sheet outer surface and a fitted sheet lower section;

a flat sheet sized and shaped to fit over at least part of the fitted sheet outer surface, the flat sheet defining a flat sheet outer surface, a flat sheet lower longitudinal edge, a flat sheet first side longitudinal edge, a flat sheet second side longitudinal edge and a flat sheet lower section, at least part of the flat sheet lower section being fixedly secured using stitching to at least part of the fitted sheet lower section, the flat sheet further defining a flat sheet upper longitudinal edge section;

a bedspread sized and shaped to fit over the flat sheet outer surface, the bedspread defining a bedspread outer surface, a bedspread lower longitudinal edge, a bedspread first side longitudinal edge and a bedspread second side longitudinal edge opposite the bedspread first side longitudinal edge, at least part of the bedspread lower longitudinal edge, the bedspread first side longitudinal edge and the bedspread second side longitudinal edge being releasably connected to at least part of respectively the flat sheet lower longitudinal edge, the flat sheet first side longitudinal edge and the flat sheet second side longitudinal edge along their respective lengths; and the flat sheet upper longitudinal edge section being folded over so as to create a bedspread receiving pocket configured to receive therein a bedspread upper section.

2. The bedding system of claim 1, wherein the bedspread further defines a bedspread upper longitudinal edge, at least part of the flat sheet upper longitudinal edge section being releasably secured to at least part of one of: the bedspread upper longitudinal edge along its length and the bedspread outer surface along its length.

3. The bedding system of claim 1, wherein the flat sheet defines sets of longitudinally aligned spaced apart openings at its flat sheet lower longitudinal edge, at its flat sheet first side longitudinal edge, at its flat sheet second side longitudinal edge and about its flat sheet upper section.

4. The bedding system of claim 3, wherein the bedspread defines sets of longitudinally aligned spaced apart connectors/buttons at its bedspread lower longitudinal edge, at its bedspread first side longitudinal edge, at its bedspread second side longitudinal edge and about the bedspread upper section, wherein in use, each connector/button is introduced into its respective opening to releasably couple the bedspread lower longitudinal edge, the bedspread first side longitudinal edge, the bedspread second side longitudinal edge and the bedspread upper section to respectively the flat sheet lower longitudinal edge, the flat sheet first side longitudinal edge, the flat sheet second side longitudinal edge and the flat sheet upper section along their respective lengths.

5. A cover for a bed, in which the bed includes a mattress having a head end portion and a foot end portion, the mattress having an upper panel and mattress sidewalls depending downwardly therefrom, the upper panel being sized and shaped to receive thereon a user body, the cover comprising a first material sheet sized and shaped to substantially fit over the upper panel of the mattress, the first material sheet having a first foot end connector portion;

a second material sheet sized and shaped to substantially cover the first material sheet, the second material sheet having a second foot end connector portion fixedly secured using stitching to the first foot end connector portion, the second material sheet having a first upper edge releasable connector portion, first and second side edge releasable connector portions, and a first lower edge releasable connector portion;

a third material sheet sized and shaped to substantially cover the second material sheet, the third material sheet having a second upper edge releasable connector portion, third and fourth side edge releasable connector portions, and a second lower edge releasable connector portion; the first upper edge releasable connector portion, the first and second side edge releasable connector portions, and the first lower edge releasable connector portion being releasably connected to the respective second upper edge releasable connector portion, the third and fourth side edge releasable connector portions, and the second lower edge releasable connector portion; and a pocket for receiving therein a top portion of the third material sheet, the second upper edge releasable connector portion when releasably connected to the second upper edge releasable connector portion of the third material is folded over to create the pocket.

6. The cover, according to claim 5, in which the first material sheet has a first area, the second material sheet has a second area, the third material sheet has a third area, the second area is larger than the first area and the third area such that the upper edge portion of the second material sheet extends beyond the upper edge of the third material sheet by an amount sufficient to permit the formation of the pocket.

7. The cover, according to claim 5, in which the third material sheet further defines a third material sheet upper longitudinal edge, at least part of the first material sheet upper longitudinal edge section being releasably connected to at least part of one of: the third material sheet upper longitudinal edge along its length and the third material outer surface along its length.

8. The cover, according to claim 5, in which the first material sheet includes sets of longitudinally aligned spaced apart openings at a first material sheet lower longitudinal edge, at a first material sheet first side longitudinal edge, at a first material sheet second side longitudinal edge and about a first material sheet upper section.

9. The cover, according to claim 5, in which the third material sheet includes sets of longitudinally aligned spaced apart buttons located at a third material sheet lower longitudinal edge, at a third material sheet first side longitudinal edge, at a third material sheet second side longitudinal edge and about the third material sheet upper section.

10. The cover, according to claim 5, in which the second material sheet is releasably connected to the third material sheet such that a second material sheet surface is disposed towards the user body.

11. The cover, according to claim 5, in which the first material sheet is a fitted sheet; the second material sheet is a flat sheet; and the third material sheet is a bedspread.

12. A system for fastening bed sheets, comprising:

a fitted sheet having a fitted sheet outer surface and a fitted sheet lower section;

a flat sheet having a flat sheet outer surface, a flat sheet lower longitudinal edge, a flat sheet first side longitudinal edge, a flat sheet second side longitudinal edge and a flat sheet lower section;

a portion of the flat sheet lower section being fixedly secured using stitching to a portion of the fitted sheet lower section, the flat sheet further defining a flat sheet upper longitudinal edge section;

a bedspread having a bedspread outer surface, a bedspread lower longitudinal edge, a bedspread first side longitudinal edge and a bedspread second side longitudinal edge opposite the bedspread first side longitudinal edge; and a portion of the bedspread lower longitudinal edge, the bedspread first side longitudinal edge and the bedspread second side longitudinal edge being releasably connected to a portion of respectively the flat sheet lower longitudinal edge, the flat sheet first side longitudinal edge and the flat sheet second side longitudinal edge along their respective lengths.

* * * * *